US005928854A

United States Patent [19]

Hioki

[11] Patent Number: 5,928,854

[45] Date of Patent: Jul. 27, 1999

[54] SILVER HALIDE PHOTOSENSITIVE MATERIAL

[75] Inventor: Takanori Hioki, Kanagawa, Japan

[73] Assignee: Fuji Photo Film Co., Ltd., Kanagawa, Japan

[21] Appl. No.: 09/088,730

[22] Filed: Jun. 2, 1998

[30] Foreign Application Priority Data

Jul. 9, 1997 [JP] Japan ..... 9-184206

[51] Int. Cl.[6] ..... G03C 1/22; G03C 1/24

[52] U.S. Cl. ..... 430/591; 430/573; 430/578; 430/580; 430/587; 430/590; 430/592

[58] Field of Search ..... 430/573, 578, 430/587, 590, 591, 592, 580

[56] References Cited

U.S. PATENT DOCUMENTS 2,166,736 7/1939 White et al. ..... 430/578

*Primary Examiner*—Richard L. Schilling
*Assistant Examiner*—Amanda C. Walke
*Attorney, Agent, or Firm*—Sughrue, Mion, Zinn, Macpeak & Seas, PLLC

[57] ABSTRACT

A silver halide photosensitive material is described, which comprises at least one of the compounds represented by the following formula (I)

wherein $Z_1$ and $Z_2$ each represents an atomic group necessary for forming a five- or six-membered nitrogen-containing heterocyclic ring, $R_1$, $R_2$, $R_3$ and $R_4$ each represents an alkyl group, an aryl group or a heterocyclic group, Q represents a divalent linking group or a single bond, with the proviso that at least one of $R_1$, $R_2$, $R_3$, $R_4$ and Q is substituted with a water-soluble group, $L_1$, $L_2$, $L_3$, $L_4$, $L_5$, $L_6$, $L_7$ and $L_8$ each represents a methine group, $n_1$ and $n_2$ each is 0, 1, 2, 3 or 4, $p_1$ and $p_2$ each is 0 or 1, $M_1$ represents a charge equilibrium counter ion, and $m_1$ is a number of from 0 to 10, which is necessary for neutralizing charge of the molecule.

2 Claims, No Drawings

SILVER HALIDE PHOTOSENSITIVE MATERIAL

FIELD OF THE INVENTION

This invention relates to a silver halide photosensitive material which contains a novel methine compound.

BACKGROUND OF THE INVENTION

Great efforts have hitherto been made to increase sensitivity of silver halide photosensitive materials. In the case of sensitizing dyes, it is considered that increase in their light absorption factor will render possible improvement of the transfer efficiency of light energy to a silver halide and achievement of increased spectral sensitivity.

However, the amount of adsorption of a sensitizing dye on the surface of silver halide grains has a limitation, so that it is difficult to adsorb the sensitizing dye more than its single layer saturation adsorption. In consequence, it is the current situation that the absorption factor of incident light quantum of individual silver halide grains is extremely small in the spectral sensitization range.

The following describes methods which have been proposed for the purpose of resolving these problems.

In *Photographic Science and Engineering,* vol. 20, no. 3, p. 97 (1976), P. G. Gilman, Jr. et al. have adsorbed a cation dye to the first layer and an anion dye was adsorbed to the second layer making use of electrostatic force.

In U.S. Pat. No. 3,622,316, G. B. Bird et al. have attained sensitization through the contribution of Forster type excitation energy transfer, by adsorbing a plurality of dyes to multiple layers of a silver halide.

In JP-A-63-138341 and JP-A-64-84244 (the term "JP-A" as used herein means an "unexamined published Japanese patent application"), Sugimoto et al. have carried out spectral sensitization by energy transfer from a luminous dye.

In *Photographic Science and Engineering,* vol. 27, no. 2, p. 59 (1983), R. Steiger et al. have attempted to effect spectral sensitization by energy transfer from a gelatin-substituted cyanine dye.

In JP-A-61-251842, Ikekawa et al. have carried out spectral sensitization by energy transfer from a cyclodextrin-substituted dye.

So-called connected dye which has two chromophores not separately conjugated but connected by covalent bond is disclosed, for example, in U.S. Pat. Nos. 2,393,351, 2,425,772, 2,518,732, 2,521,944, and 2,592,196, European Patent 565,083 and the like. However, these attempts were not aimed at improving light absorption factor. As a positive effort to improve light absorption factor, G. B. Bird, A. L. Borror et al. in U.S. Pat. Nos. 3,622,317 and 3,976,493 have attempted to increase sensitization through the contribution of energy transfer by increasing light absorption factor which was effected by adhering a connected type sensitizing dye molecule having a plurality of cyanine chromophores. In JP-A-64-91134, Ukai, Okazaki and Sugimoto have proposed a method in which at least one substantially non-adsorbent dye containing at least two sulfo groups and/or carboxyl groups is connected to a spectral sensitizing dye capable of being adsorbed to a silver halide.

In addition, M. R. Roberts et al. have proposed, in U.S. Pat. No. 4,950,587, spectral sensitization by a cyanine dye polymer.

Thus, though a large number of attempts have so far been made with the aim of improving light absorption factor, each of these attempts is not sufficient in improving high sensitivity effect and has problems in terms of increased specific desensitization, development inhibition and the like.

Because of the above reasons, great concern has been directed toward the development of a spectral sensitization technique which renders possible achievement of high sensitivity of a silver halide sensitive material through the improvement of its light absorption factor.

SUMMARY OF THE INVENTION

In view of the above, it therefore becomes an object of the present invention to provide a silver halide photosensitive material which has high light absorption factor and high sensitivity.

With the aim of achieving the above object, the inventor of the present invention has conducted intensive studies and accomplished the invention as a result of the efforts based on the following items (1) and (2).

(1) A silver halide photosensitive material comprising a support having provided thereon a silver halide emulsion layer, said silver halide photosensitive material comprising at least one of the compounds represented by the following formula (I)

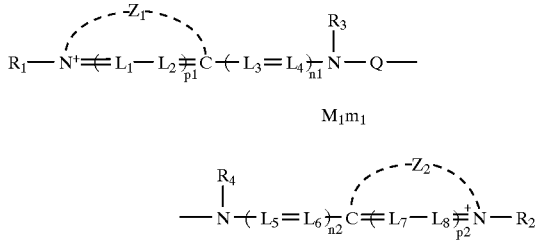

wherein $Z_1$ and $Z_2$ each represents an atomic group necessary for forming a five- or six-membered nitrogen-containing heterocyclic ring, $R_1$, $R_2$, $R_3$ and $R_4$ each represents an alkyl group, an aryl group or a heterocyclic group, Q represents a divalent linking group or a single bond, with the proviso that at least one of $R_1$, $R_2$, $R_3$, $R_4$ and Q is substituted with a water-soluble group, wherein the water-soluble group is preferably a sulfo group or a salt thereof, $L_1$, $L_2$, $L_3$, $L_4$, $L_5$, $L_6$, $L_7$ and $L_8$ each represents a methine group, $n_1$ and $n_2$ each is 0, 1, 2, 3 or 4, $p_1$ and $p_2$ each is 0 or 1, $M_1$ represents a charge equilibrium counter ion, and ml is a number of from 0 to 10, which is necessary for neutralizing charge of the molecule.

(2) The silver halide photosensitive material according to the above item (1), wherein in the compound represented by the formula (I) described in the above item (1), at least one of $R_1$, $R_2$, $R_3$, $R_4$ and Q is substituted with a sulfo group or a salt thereof.

Other objects and advantages of the present invention will be made apparent as the description progresses.

DETAILED DESCRIPTION OF THE INVENTION

Examples of the five- or six-membered nitrogen-containing heterocyclic ring represented by $Z_1$ and $Z_2$ in the aforementioned formula (I) include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, a 3,3-dialkylindolenine nucleus (3,3-dimethylindolenine, for instance), imidazoline nucleus, imidazole nucleus, benzimidazole nucleus, pyrroline nucleus, 2-pyridine nucleus, 4-pyridine nucleus, 2-quinoline nucleus, 4-quinoline nucleus, 1-isoquinoline nucleus, 3-isoquinoline nucleus, imidazo[4,5-b]quinoxaline nucleus, oxadiazole nucleus, thiadiazole nucleus, tetrazole nucleus and pyrimidine nucleus.

Among the above, preferred are oxazoline nucleus, oxazole nucleus, benzoxazole nucleus, thiazoline nucleus, thiazole nucleus, benzothiazole nucleus, imidazoline nucleus, imidazole nucleus, benzimidazole nucleus and pyrroline nucleus, more preferred are oxazoline nucleus, thiazoline nucleus, imidazoline nucleus and pyrroline nucleus, and most preferred is imidazoline nucleus.

Also, each of $p_1$ and $p_2$ is 0 or 1, preferably 0.

When the substituent group on $Z_1$ and $Z_2$ is defined as V, examples of the substituent group represented by V include, though not particularly limited, halogen atoms (chlorine, bromine, iodine and fluorine, for instance), mercapto group, cyano group, carboxyl group, phosphate group, sulfo group, hydroxy group, a carbamoyl group having 1 to 10, preferably 2 to 8, more preferably 2 to 5, carbon atoms (for example, methylcarbamoyl, ethylcarbamoyl or morpholinocarbamoyl), a sulfamoyl group having 0 to 10, preferably 2 to 8, more preferably 2 to 5, carbon atoms (for example, methylsulfamoyl, ethylsulfamoyl or piperidinosulfonyl), nitro group, an alkoxy group having 1 to 20, preferably 1 to 10, more preferably 1 to 8, carbon atoms (for example, methoxy, ethoxy, 2-methoxyethoxy or 2-phenylethoxy), an aryloxy group having 6 to 20, preferably 6 to 12, more preferably 6 to 10, carbon atoms (for example, phenoxy, p-methylphenoxy, p-chlorophenoxy or naphthoxy), an acyl group having 1 to 20, preferably 2 to 12, more preferably 2 to 8,-carbon atoms (for example, acetyl, benzoyl or trichloroacetyl), an acyloxy group having 1 to 20, preferably 2 to 12, more preferably 2 to 8, carbon atoms (for example, acetyloxy or benzoyloxy), an acylamino group having 1 to 20, preferably 2 to 12, more preferably 2 to 8, carbon atoms (for example, acetylamino), a sulfonyl group having 1 to 20, preferably 1 to 10, more preferably 1 to 8, carbon atoms (for example, methanesulfonyl, ethanesulfonyl, benzenesulfonyl or the like), a sulfinyl group having 1 to 20, preferably 1 to 10, more preferably 1 to 8, carbon atoms (for example, methanesulfonyl or benzenesulfonyl), a sulfonylamino group having 1 to 20, preferably 1 to 10, more preferably 1 to 8, carbon atoms (methanesulfonylamino, ethanesulfonylamino, benzenesulfonylamino or the like, for example), an amino group, a substituted amino group having 1 to 20, preferably 1 to 12, more preferably 1 to 8, carbon atoms (for example, methylamino, dimethylamino, benzylamino, anilino or diphenylamino), an ammonium group having 0 to 15, preferably 3 to 10, more preferably 3 to 6, carbon atoms (trimethylammonium or triethylammonium, for example), a hydrazino group having 0 to 15, preferably 1 to 10, more preferably 1 to 6, carbon atoms (for example, trimethylhydrazino), a ureido group having 1 to 15, preferably 1 to 10, more preferably 1 to 6, carbon atoms (for example, ureido or N,N-dimethylureido), an imido group having 1 to 15, preferably 1 to 10, more preferably 1 to 6, carbon atoms (for example, succinimido), an alkyl or arylthio group having 1 to 20, preferably 1 to 12, more preferably 1 to 8, carbon atoms (for example, methylthio, ethylthio, carboxyethylthio, sulfobutylthio, phenylthio or the like), an alkoxycarbonyl group having 2 to 20, preferably 2 to 12, more preferably 2 to 8, carbon atoms (for example, methoxycarbonyl, ethoxycarbonyl or benzyloxycarbonyl), an aryloxycarbonyl group having 6 to 20, preferably 6 to 12, more preferably 6 to 8, carbon atoms (for example, phenoxycarbonyl), an unsubstituted alkyl group having 1 to 18, preferably 1 to 10, more preferably 1 to 5, carbon atoms (for example, methyl, ethyl, propyl or butyl), a substituted alkyl group having 1 to 18, preferably 1 to 10; more preferably 1 to 5, carbon atoms (hydroxymethyl, trifluoromethyl, benzyl, carboxyethyl, ethoxycarbonylmethyl or acetylaminomethyl, for example; in this case, an unsaturated hydrocarbon group preferably having 2 to 18, more preferably 3 to 10, most preferably 3 to 5, carbon atoms (for example, vinyl, ethynyl, 1-cyclohexenyl, benzylidyne or benzylidene) is also to be included in the substituted alkyl group), a substituted or unsubstituted aryl group having 6 to 20, preferably 6 to 15, more preferably 6 to 10, carbon atoms (phenyl, naphthyl, p-carboxyphenyl, p-nitrophenyl, 3,5-dichlorophenyl, p-cyanophenyl, m-fluorophenyl or p-tolyl, for example), and a heterocyclic group which may be substituted, having 1 to 20, preferably 2 to 10, more preferably 4 to 6, carbon atoms (pyridyl, 5-methylpyridyl, thienyl, furyl, morpholino or tetrahydrofurfuryl, for example). Also, each of these substituent groups may have a structure in which benzene ring, naphthalene ring or anthracene ring is condensed therewith. In addition, V may be further substituted on these substituent groups.

Among the just described substituent groups on $Z_1$ and $Z_2$, preferred are an alkyl group, an aryl group, an alkoxy group, a halogen atom, an acyl group, a cyano group, a sulfonyl group and a benzene ring condensate, more preferred are an alkyl group, an aryl group, a halogen atom, an acyl group, a sulfonyl group and a benzene ring condensate, and most preferred are methyl group, phenyl group, methoxy group, chlorine atom, bromine atom, iodine atom and benzene ring condensate, of which phenyl group, chlorine atom, bromine atom and iodine atom are most particularly preferred.

The methine group represented by $L_1$, $L_2$, $L_7$ or $L_8$ may have a substituent group, and examples of the substituent group include those which are described in the foregoing in relation to V, of which unsubstituted methylene group is preferred.

The group Q in the formula (I) is a divalent linking group or a single bond, preferably a divalent linking group. The divalent linking group preferably comprises an atom or an atomic group including at least one of carbon atom, nitrogen atom, sulfur atom and oxygen atom. Preferably, it is a divalent linking group having 1 to 20 carbon atoms, which is constructed by combining one or more of an alkylene group (for example, methylene, ethylene, propylene, butylene or pentylene), an arylene group (for example, phenylene or naphthylene), an alkenylene group (for example, ethenylene or propenylene), an alkynylene group (for example, ethynylene or propionylene), amido group, ester group, sulfamido group, sulfonate group, ureido group, sulfonyl group, sulfinyl group, thioether group, ether group, carbonyl group, —N(Ra)— (wherein Ra represents hydrogen atom, a substituted or unsubstituted alkyl group or a substituted or unsubstituted aryl group) and a heterocyclic divalent group (for example, 6-chloro-1,3,5-triazine-2,4-diyl, pyrimidine-2,4-diyl or quinoxaline-2,3-diyl). Each of these divalent linking groups may be further substituted, and the aforementioned V can be exemplified as the substituent group. More preferably, it is a divalent linking group having 1 to 10 carbon atoms, which is constructed by combining one or more of an alkylene group having 1 to 4 carbon atoms (for example, methylene, ethylene, propylene or butylene), an arylene group having 6 to 10 carbon atoms (for example, phenylene or naphthylene), an alkenylene group having 1 to 4 carbon atoms (for example, ethenylene or propenylene) and an alkynylene group having 1 to 4 carbon atoms (for example, ethynylene or propionylene).

Each of $R_1$, $R_2$, $R_3$ and $R_4$ in the formula (I) represents an alkyl group, an aryl group or a heterocyclic group. Examples of the alkyl group include an unsubstituted alkyl group having 1 to 18, preferably 1 to 7, more preferably 1 to 4, carbon atoms (for example, methyl, ethyl, propyl, isopropyl, butyl, isobutyl, hexyl, octyl, dodecyl or octadecyl) and substituted alkyl group having 1 to 18, preferably 1 to 7, more preferably 1 to 4, carbon atoms {for example, an alkyl group substituted with V cited in the foregoing as the substituent group of $Z_1$ and the like, preferably an aralkyl group (for example, benzyl or 2-phenylethyl), an unsaturated hydrocarbon group (for example, allyl), a hydroxyalkyl group (for example, 2-hydroxyethyl or 3-hydroxypropyl), a carboxyalkyl group (for example, 2-carboxyethyl, 3-carboxypropyl, 4-carboxybutyl or carboxymethyl), an alkoxyalkyl group (2-methoxyethyl or 2-(2-methoxyethoxy) ethyl, for example), an aryloxyalkyl group (for example, 2-phenoxyethyl or 2-(1-naphthoxy)ethyl), an alkoxycarbonylalkyl group (ethoxycarbonylmethyl or 2-benzyloxycarbonylethyl, for example), an aryloxycarbonylalkyl group (3-phenoxycarbonylpropyl, for example), an acyloxyalkyl group (for example, 2-acetyloxyethyl), an acylalkyl group (for example, 2-acetylethyl), a carbamoylalkyl group (for example, 2-morpholinocarbonylethyl), a sulfamoylalkyl group (for example, N,N-dimethylcarbamoylmethyl), a sulfoalkyl group (for example, 2-sulfoethyl, 3-sulfopropyl, 3-sulfobutyl, 4-sulfobutyl, 2-[3-sulfopropoxy]ethyl, 2-hydroxy-3-sulfopropyl or 3-sulfopropoxyethoxyethyl), a sulfoalkenyl group (for example, sulfopropenyl group), a sulfatoalkyl group (for example, 2-sulfatoethyl, 3-sulfatopropyl or 4-sulfatobutyl), a heterocyclic ring-substituted alkyl group (such as 2-(pyrrolidin-2-on-1-yl)ethyl, tetrahydrofurfuryl or the like), an alkylsulfonylcarbamoylalkyl group (methanesulfonylcarbamoylmethyl, for example), an alkylsulfonylsulfamoylalkyl group (for example, methanesulfonylsulfamoylmethyl), an acylcarbamoylalkyl group (for example, acetylcarbamoylmethyl) or an acylsulfamoylalkyl group (for example, acetylsulfamoylmethyl)}.

Examples of the aryl group include an unsubstituted aryl group having 6 to 20, preferably 6 to 10, more preferably 6 to 8, carbon atoms (for example, phenyl or 1-naphthyl) and substituted aryl group having 6 to 20, preferably 6 to 10, more preferably 6 to 8, carbon atoms (for example, an aryl group substituted with V cited in the foregoing as the substituent group of $Z_1$ and the like, and its illustrative examples include p-methoxyphenyl, p-methylphenyl, p-chlorophenyl and the like groups).

Examples of the heterocyclic group include an unsubstituted heterocyclic group having 1 to 20, preferably 3 to 10, more preferably 4 to 8, carbon atoms (for example, 2-furyl, 2-thienyl, 2-pyridyl, 3-pyrazolyl, 3-isoxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl or the like group) and substituted heterocyclic group having 1 to 20, preferably 3 to 10, more preferably 4 to 8, carbon atoms (for example, a heterocyclic group substituted with V cited in the foregoing as the substituent group of $Z_1$ and the like, and its illustrative examples include 5-methyl-2-thienyl, 4-methoxy-2-pyridyl and the like groups).

Preferred as $R_1$ or $R_2$ is an alkyl group, more preferably the aforementioned carboxyalkyl group, sulfoalkyl group or unsubstituted alkyl group and most preferably a sulfoalkyl group or an unsubstituted alkyl group.

Preferred as $R_3$ or $R_4$ is the aforementioned unsubstituted alkyl group, sulfoalkyl group, carboxyalkyl group, unsubstituted aryl group or unsubstituted heterocyclic group, more preferably methyl, ethyl, 2-sulfoethyl, 3-sulfopropyl, 3-sulfobutyl, 4-sulfobutyl, carboxymethyl, phenyl, 2-pyridyl, 2-thiazolyl or the like group.

In addition, $R_3$ and $R_4$ may together form a divalent linking group similar to the aforementioned Q.

At least one of the aforementioned $R_1$, $R_2$, $R_3$, $R_4$ and Q is substituted with a water-soluble group. The water-soluble group may be any group which becomes anion by its dissociation, and its examples include sulfo, sulfato, carboxy, phosphono, alkylsulfonylcarbamoyl, alkylsulfonylsulfamoyl, acylcarbamoyl, acylsulfamoyl and the like groups and salts thereof.

Among these groups, sulfo group, sulfato group, carboxy group and salts thereof are preferred, and sulfo group or a salt thereof is particularly preferred.

In the formula (I), $L_3$, $L_4$, $L_5$ and $L_6$ each independently represents a methine group. These methine groups may have a substituent group, and examples of the substituent group include a substituted or unsubstituted alkyl group having 1 to 15, preferably 1 to 10, more preferably 1 to 5, carbon atoms (for example, methyl, ethyl or 2-carboxyethyl), a substituted or unsubstituted aryl group having 6 to 20, preferably 6 to 15, more preferably 6 to 10, carbon atoms (for example, phenyl or o-carboxyphenyl), a substituted or unsubstituted heterocyclic group having 3 to 20, preferably 4 to 15, more preferably 6 to 10, carbon atoms (for example, N,N-diethylbarbituric acid group), a halogen atom (for example, chlorine, bromine, fluorine or iodine), an alkoxy group having 1 to 15, preferably 1 to 10, more preferably 1 to 5, carbon atoms (for example, methoxy or ethoxy), an alkylthio group having 1 to 15, preferably 1 to 10, more preferably 1 to 5, carbon atoms (for example, methylthio or ethylthio), an arylthio group having 6 to 20, preferably 6 to 15, more preferably 6 to 10, carbon atoms (for example, phenylthio) and an amino group having 0 to 15, preferably 2 to 10, more preferably 4 to 10, carbon atoms (for example, N,N-diphenylamino, N-methyl-N-phenylamino or N-methylpiperazino). Also, it may form a ring together with other methine group or with the auxochrome $Z_1$ or $Z_2$ or the substituent group $R_1$, $R_2$, $R_3$, $R_4$ or Q on the auxochrome.

Preferred as $n_1$ or $n_2$ is 0, 1, 2 or 3, more preferably 0, 1 or 2, and most preferably 2. When $n_1$ or $n_2$ is 2 or more, the methine group is repeated but not necessarily the same group.

In the formula (I), $M_1$ is included in order to show the presence of a cation or anion when it is necessary to neutralize ionic charge of the dye. Typical examples of the cation Include hydrogen ion ($H^+$), an alkali metal ion (for example, sodium ion, potassium ion or lithium ion), an alkaline earth metal ion (for example, calcium ion) and the like inorganic cations and an ammonium ion (for example, ammonium ion, tetraalkylammonium ion, pyridinium ion or ethylpyridinium ion) and the like organic ions. The anion may be either inorganic anion or organic anion, and its examples include a halogen anion (for example, fluorine ion, chlorine ion or iodine ion), a substituted arylsulfonate ion (for example, p-toluenesulfonate ion or p-chlorobenzenesulfonate ion), an aryldisulfonate ion (for example, 1,3-benzenesulfonate ion, 1,5-naphthalenedisulfonate ion or 2,6-naphthalenedisulfonate ion), sulfate ion, thiocyanate ion, perchlorate ion, tetrafluoroborate ion, picrate ion, acetate ion, trifluoromethanesulfonate ion and the like. In addition, other dye having reverse charge of the ionic polymer or dye may also be used.

According to the present invention, the sulfo group is represented by $SO_3^-$, but it is possible to represent it as $SO_3H$ when it has hydrogen ion as the counter ion.

The factor $m_1$ is a number necessary for neutralizing the charge, which is 0 when a salt is formed inside the molecule.

The following shows illustrative examples of the compound represented by the formula (I) of the present invention, though the invention is not restricted thereby.

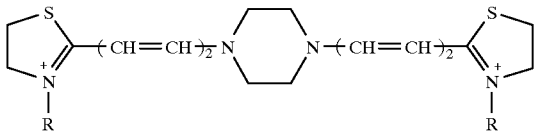

(1) $R=(CH_2)_3SO_3^-$
(2) $R=CH_2CO_2^-$
(3) $R=CH_2CO\overline{N}SO_2CH_3$
(4) $R=-(CH_2)_4SO_3^-$
(5) $R=(CH_2)_2OSO_3^-$
(6) $R=(CH_2)_3OSO_3^-$
(7) $R=CH_2SO_2\overline{N}SO_2CH_3$
(8) $R=CH_2CO\overline{N}COCH_3$
(9) $R=CH_2SO_2\overline{N}COCH_3$

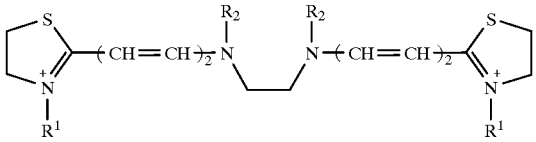

2M

(10) $R_1=(CH_2)_3SO_3^-$, $R_2=CH_3$, M=-
(11) $R_1=(CH_2)_3SO_3^-$, $R_2=(CH_2)_2OH$ , M=-
(12) $R_1=(CH_2)_3SO_3^-$, $R_2=(CH_2)_2OSO_3^-$, $M=Na^+$
(13) $R_1=(CH_2)_3CO_2^-$, $R_2=(CH_2)_2OH$ , M=-
(14) $R_1=CH_2CO\overline{N}SO_2CH_3$, $R_2=CH_3$, M=-
(15) $R_1=C_2H_5$, $R_2=(CH_2)_2OSO_3^-$, M=-

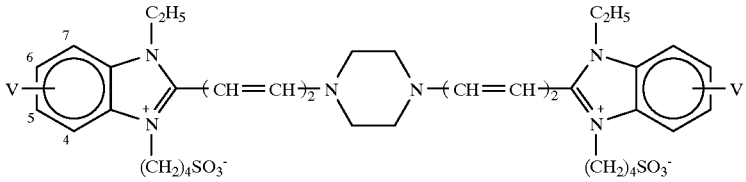

(16) V=H
(17) V=5-Cl
(18) V=5,6-$Cl_2$
(19) V=5-CN-6-Cl
(20) V=5-$CF_3$
(21) V=5-$CF_3$-6-Cl

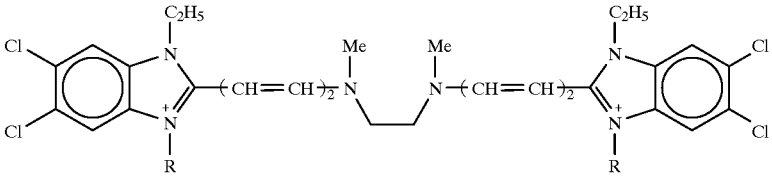

(22) $R=(CH_2)_2SO_3^-$
(23) $R=CH_2CO_2^-$
(24) $R=CH_2CO\overline{N}SO_2CH_3$
(25) $R=(CH_2)_4SO_3^-$
(26) $R=(CH_2)_2OSO_3^-$

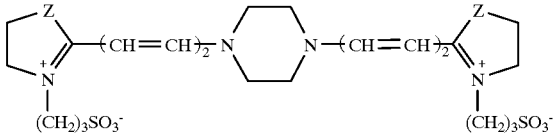

(27) Z=O
(28) Z=Se
(29) Z=N—$C_2H_5$
(30) Z=$CH_2$
(31)
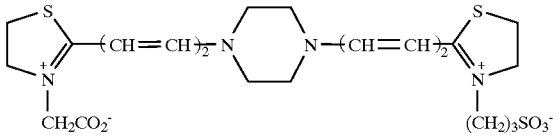
(32)
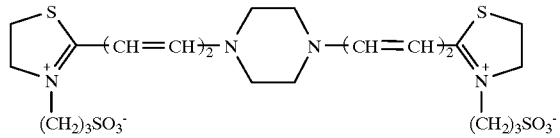
(33)
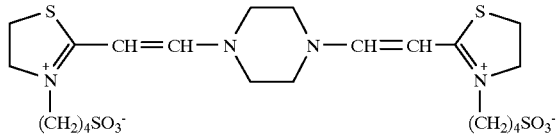
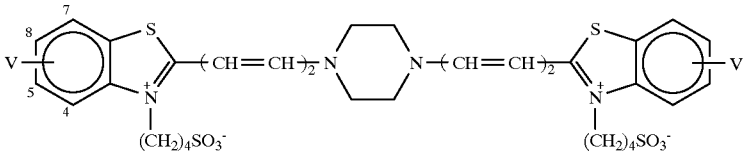
(34) V=5-Cl
(35) V=H
(36) V=5-$OCH_3$
(37) V=4,5-benzo
(38) V=5-$CH_3$
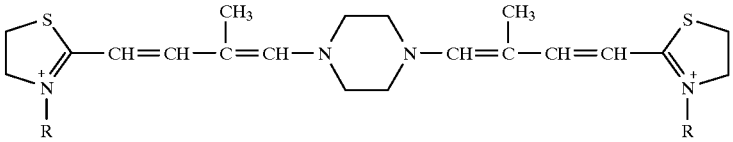
(39) R=$(CH_2)_3SO_3^-$
(40) R=$(CH_2)_2OSO_3^-$
(41) R=$CH_2CO_2^-$
(42) R=$CH_2CO\overline{N}SO_2CH_3$
(43) R=$(CH_2)_2CO\overline{N}SO_2CH_3$
(44) R=$(CH_2)_3CO_2^-$
(45)
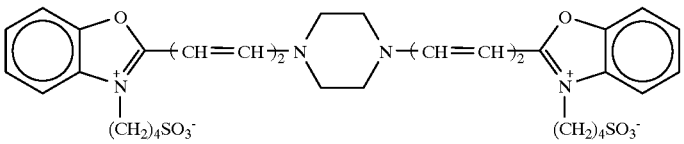

The compounds represented by the formula (I) of the present invention can be synthesized in accordance with the methods described, for example, in "Heterocyclic Compounds—Cyanine Dyes and Related Compounds", edited by F. M. Harmer, published by John Wiley & Sons, New York, London, 1964, "Heterocyclic Compounds—Special topics in heterocyclic chemistry", edited by D. M. Sturmer, published by John Wiley & Sons, New York, London, chapter 18, paragraph 14, pp. 482–515, 1977 and "Rodd's Chemistry of Carbon Compounds", published by Elsevier Science Publishing Company Inc., New York, 2nd. ed., vol. IV, part B, chapter 15, pp. 369–422, 1977.

(Synthesis Example); Synthesis of compound (1)

This compound was synthesized according to the following reaction scheme.

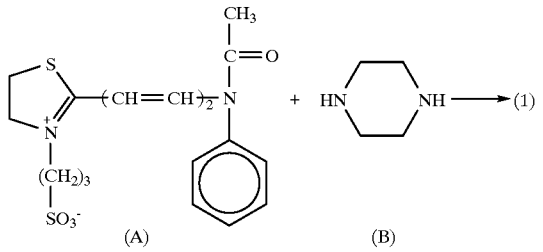

A 0.32 g (0.0037 mol) portion of (B) was added to 3 g (0.0083 mol) of (A) and 100 ml of ethanol, and the mixture was heated under reflux for 1 hour on a steam bath. After spontaneous cooling, the thus precipitated crystals were collected by suction filtration, the thus obtained powder was heated under reflux for 1 hour in 250 ml methanol/350 ml chloroform, and then 250 ml of the solvent was evaporated under normal pressure. After standing, the thus precipitated crystals were collected by suction filtration and dried. Compound (1): yellow powder, yield=1.45 g, percentage yield=65%, λmax=457 nm, ϵ=232000 (methanol), melting point=250° C. or more Next, the silver halide photosensitive material of the present invention is described in detail.

The compound represented by the formula (I) according to the present invention (to be referred to as "methine compound for use in the present invention" hereinafter) can be used in the silver halide photosensitive material, alone or in combination with other sensitizing dye.

Timing for the addition of the compound for use in the present invention (as well as other sensitizing dye) to the silver halide emulsion for use in the present invention may be at any step of the emulsion preparation so far recognized as useful. For example, it may be added during any period or step before coating of the emulsion, such as a period before the grain forming step or/and desalting of a silver halide or during a period starting in and/or after the desalting step until commencement of chemical aging, as described in U.S. Pat. Nos. 2,735,766, 3,628,960, 4,183,756, and 4,225,666, JP-A-58-184142 and JP-A-60-196749, or a period just before or during the chemical aging step or a period after chemical aging until coating, as described in JP-A-58-113920. In addition, as described in U.S. Pat. No. 4,225,666 and JP-A-58-7629, the same compound alone or a mixture thereof with a compound of different structure may be added in portions, for example, by adding its divided portions during the grain forming step and during or after the chemical aging step, or before or during the chemical aging step and after completion of the step, and kinds of the compound and combination of compounds to be added in portions may be changed.

Amount of the compound for use in the present invention to be added may vary depending on the shape and size of the silver halide grains, but it can be used in an amount of from $1\times10^{-6}$ to $8\times10^{-3}$ mol based on 1 mol of the silver halide. For example, when the silver halide has a grain size of from 0.2 to 1.3 μm, it may be added in an amount of preferably from $2\times10^{-6}$ to $3.5\times10^{-3}$ mol, more preferably from $7.5\times10^{-6}$ to $1.5\times10^{-3}$ mol, based on 1 mol of the silver halide.

The compound for use in the present invention can be dispersed directly in the emulsion. Alternatively, it may be firstly dissolved in an appropriate solvent such as methyl alcohol, ethyl alcohol, methyl cellosolve, acetone, water, pyridine or a mixed solvent thereof and then added in the solution form to the emulsion. In that case, a base, an acid, a surface active agent and the like additives can coexist. Also, ultrasonic wave can be used for the dissolution. Examples of the useful methods for the addition of the methine compound include a method described, for example, in U.S. Pat. No. 3,469,987 in which said compound is dissolved in a volatile organic solvent, said solution is dispersed in a hydrophilic colloid and then the dispersion is added to the emulsion, a method described, for example, in JP-B-46-24185 (the term "JP-B" as used herein means an "examined Japanese patent publication") in which the compound is dispersed in an water-soluble solvent and the dispersion is added to the emulsion, a method described, for example, in U.S. Pat. No. 3,822,135 in which the methine compound is dissolved in a surface active agent and said solution is added to the emulsion, a method described, for example, in JP-A-51-74624 in which it is dissolved using a compound capable of causing red shift and the resulting solution is added to the emulsion and a method described, for example, in JP-A-50-80826 in which the methine compound is dissolved in an acid containing substantially no water and the resulting solution is added to the emulsion. In addition to the above, the methods described, for example, in U.S. Pat. Nos. 2,912,343, 3,342,605, 2,996,287 and 3,429,835 can also be used for the addition of the compound to the emulsion.

In addition, the compound for use in the present invention can be used as various types of filter dye, irradiation preventing dye, anti-halation dye and the like for the purpose of improving sharpness, color separation ability and the like properties.

This methine compound can be contained in coating solutions of a silver halide photosensitive material layer, a filter layer and/or a halation preventing layer by conventionally used means. The dye may be used in an amount sufficient to color the photographic layer, and those skilled in the art can select such an amount at will depending on the purpose of its use. In general, it is desirable to use the dye in such an amount that its optical density becomes within the range of from 0.05 to 3.0.

It may be added at any step before the coating.

In addition, it is possible to localize the dye in a specified layer, by allowing a polymer having reverse charge of the dye ions to coexist in the layer as a mordant and using its mutual reaction with the dye molecules.

Examples of the polymer mordant include those which are described, for example, in U.S. Pat. Nos. 2,548,564, 4,124,386, 3,625,694, 3,958,995, 4,168,976 and 3,445,231.

Examples of the supersensitizer useful for the spectral sensitization for use in the present invention include the pyrimidylamino compounds, triazinylamino compounds, azolium compounds and the like described, for example, in U.S. Pat. Nos. 3,511,664, 3,615,613, 3,615,632, 3,615,641, 4,596,767, 4,945,038 and 4,965,182, and the methods described in these patents are desirable as the application method.

The silver halide which can be used in the silver halide sensitive material of the present invention may be any one of silver bromide, silver iodobromide, silver iodochlorobromide, silver chlorobromide and silver chloride. Preferred silver halide is silver bromide, silver chlorobromide, silver iodochlorobromide or the high degree silver chloride described in JP-A-2-42.

Construction, processing and the like of the sensitive material are described in the following, while the construction and processing described in JP-A-2-42 are preferably used particularly in the case of the high degree silver chloride.

Also, the construction and processing described in JP-A-63-264743 are preferably used particularly in the case of silver chlorobromide.

The silver halide grains may have different phases between the inner part and surface layer or comprised of a uniform phase. Also, they may be grains in which the latent image is formed mainly on the surface (a negative type sensitive material, for example), grains in which the latent image is mainly formed inside the grains (an internal latent image type sensitive material, for example) or grains which is fogged in advance (a direct positive type sensitive material, for example).

The aforementioned silver halide grains having various halogen composition, crystal habit, inner grain structure, shape and distribution are used in sensitive photographic materials (elements) for various applications.

The silver halide grains in the photosensitive material may have a cubic, tetradecahedral, diamond dodecahedral or the like regular crystal form, a spherical, tabular or the like irregular crystal form or a complex of these crystal forms. They may be comprised of a mixture of grains of various crystal forms.

According to the photosensitive material of the present invention, it is desirable that the silver halide grains which form the emulsion layer have an aspect ratio of from 3 to 100. The term "an aspect ratio of from 3 to 100" as used herein means that silver halide grains having an aspect ratio (circle-equivalent diameter (i.e., a diameter of circle having the same area as the projected area of each grain) of silver halide grain/thickness of the grain) of from 3 to 100 are present in an amount of 50% or more of the project area of the total silver halide grains. The amount is preferably 70% or more, more preferably 85% or more. The aspect ratio is preferably from 5 to 50, more preferably from 8 to 30. The tabular grains can be prepared in accordance with the methods described in Photographic Science and Engineering, edited by Gutoff, vol. 14, pp. 248–257 (1970); U.S. Pat. Nos. 4,434,226, 4,414,310, 4,433,048, and 4,439, 520, British Patent 2,112,157 and WO 96/30808 (line 5 on page 16 to line 19 on page 20).

The methine compounds for use in the present invention can be used in sensitive materials of the following applications as sensitizers, and sensitizing dyes and for the purpose of filters, anti-halation and anti-irradiation. These dyes can be added not only to the sensitive emulsion layer but also to intermediate layer, protective layer, backing layer and the like optional layers.

The methine compound for use in the present invention can be used in various color or black-and-white silver halide photosensitive materials.

More illustratively, they can be used, for example, in a sensitive material for color positives use, a sensitive material for color paper use, a sensitive material for color negative use, a sensitive material for color reversal use (a coupler may be contained or not contained), a silver halide photosensitive material for direct positive use, a photosensitive material for photomechanical process (for example, lith films, lith-duplicating films and the like), a sensitive material for cathode ray tube display use, a sensitive material for X-ray recording use (particularly a direct or indirect radiographic material which uses a screen), a sensitive material-which is used in the silver salt diffusion transfer process, a sensitive material which is used in the color diffussion transfer process, a senstive material which is used in the dye transfer process (inhibition process), a sensitive material which is used in the silver dye bleaching and a sensitive material for heat developing use.

The silver halide photographic emulsion to be used in the present invention can be prepared in accordance with the methods described, for example, in "Chimie et Physique Photograhique" (edited by P. Glaflkides, published by Paul Montel, 1967), "Photographic Emulsion Chemistry" (edited by G. F. Duffin, published by The Focal Press, 1966) and "Making and Coating Photographic Emulsion" (edited by V. L. Zelikman et al., published by The Focal Press, 1964).

In order to control growth of grains at the time of the formation of silver halide grains, it may be effective to use silver halide solvents such as ammonia, potassium thiocyanate, ammonium thiocyanate, thioether compounds (for example, those which are described in U.S. Pat. Nos. 3,271,157, 3,574,628, 3,704,130, 4,297,439, 4,276,374 and the like), thione compounds (for example, those which are described in JP-A-53-144319, JP-A-53-82408 JP-A-55-77737 and the like) and amine compounds (for example, those which are described in JP-A-54-100717 and the like).

In the grain formation or physical aging step of the silver halide grains, a cadmium salt, a zinc salt, a thallium salt, an-iridium salt or a complex salt thereof, a rhodium salt or a complex salt thereof, an iron salt, an iron complex salt or the like may be allowed to coexist.

Examples of the inner latent image type silver halide emulsion to be used in the present invention include a conversion type silver halide emulsion, a core/shell type silver halide emulsion and a silver halide emulsion in which other metals are included, which are described in U.S. Pat. Nos. 2,592,250, 3,206,313, 3,447,927, 3,761,276 and 3,935, 014.

The silver halide emulsion is generally subjected to chemical sensitization. For example, the method described in "Die Grundlagen der Photographischen Prozesse mit Silberhalogeniden" (edited by H. Frieser, published by Akademische Verlagsgesellschaft, pp. 675–734, 1968) can be used for the chemical sensitization.

That is, it can be effected by a single method or a combination of methods which include, for example, a sulfur salt sensitization method in which activated gelatin and a sulfur-containing compound capable of undergoing reaction with silver (for example, a thiosulfate, a thiourea, a mercapto compound or a rhodanine) are used; a selenium sensitization method; a reduction sensitization method in which a reductive substance (for example, a stannous salt, an amine, a hydrazine derivative, formamidinesulfinic acid or a silane compound) is used; and a noble metal sensitization method in which a noble metal compound (for example, a gold complex salt or a complex salt of Pt, Ir, Pd or the like group VIII metal of the periodic table) is used.

The photosensitive material to be used in the present invention can contain various compounds for the purpose of preventing fogging during production steps and preservation stage of the sensitive material or during photographic processing or of stabilizing photographic capacity. That is, a number of compounds known as fogging preventing agents or stabilizing agents can be added, and their examples include thiazoles such as benzothiazolium salts described, for example, in U.S. Pat. Nos. 3,954,478, and 4,942,721 and JP-A-59-191032, ring-opened products thereof described in JP-B-59-26731, nitroindazoles, triazoles, benzotriazoles and benzimidazoles (particularly, nitro- or halogen-substitution products); heterocyclic mercapto compounds such as mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyrimidines; aforesaid heterocyclic mercapto compounds having a water-soluble group such as a carboxyl group or a sulfo group; thioketone compounds such as oxazolinethione; azaindenes such as tetraazaindenes (particularly, 4-hydroxy-substituted (1,3,3a,7) tetraazaindenes); benzenethiosulfonic acids; benzenesulfinic acid; and acetylene compounds described in JP-A-62-87957.

The silver halide photosensitive material of the present invention can contain a cyan coupler, a magenta coupler, a yellow coupler and the like color couplers and coupler-dispersing compounds.

That is, it may contain certain compounds which can form colors by their oxidation coupling with aromatic primary amine developing agents (such as a phenylelediamine derivative, an aminophenol derivative and the like). For example, 5-pyrazolone coupler, pyrazolobenzimidazole coupler, cyanoacetylcoumarone coupler, open chain acylacetonitrile coupler and the like can be exemplified as the magenta coupler, acylacetoamide couplers (for instance, benzoylacetoanilides and pivaloylacetoanilides) can be exemplified as the yellow coupler, and naphthol coupler and phenol coupler can be exemplified as the cyan coupler. It is desirable that these couplers are non-diffusible compounds which have a hydrophobic group so-called ballast group in the molecule. The coupler may be either of four equivalency or two equivalency to the silver ion. Also, it may be either a colored coupler having a color correcting effect or a coupler (so-called DIR coupler) which releases a development inhibitor when developed.

In addition to the DIR coupler, the sensitive material of the present invention may contain a non-color-forming DIR coupling compound which produces a colorless product by the coupling reaction and releases a development inhibitor.

In order to improve sensitivity and contrast or to enhance development, the photosensitive material of the present invention may contain other compounds such as a polyalkylene oxide or its ether, ester, amine and the like derivatives, a thioether compound, thiomorpholines, a quaternary ammonium salt compound, a urethane derivative, a urea derivative, an imidazole derivative, 3-pyrazolidones and the like.

In addition to the methine compound for use in the present invention, the silver halide sensitive material of the present invention may contain various dyes as filter dyes or for the irradiation prevention and the like various other purposes.

Examples of such dyes include oxonol dyes having pyrazolone nucleus or barbituric acid nucleus disclosed, for instance, in British Patents 506,385, 1,177,429, 1,311,884, 1,338,799, 1,385,371, 1,467,214, 1,433,102, and 1,553,516, JP-A-48-85130, JP-A-49-114420, JP-A-52-117123, JP-A-55-161233, JP-A-59-111640, JP-B-39-22069, JP-B-43-13168, JP-B-62-273527, and U.S. Pat. Nos. 3,247,127, 3,469,958 and 4,078,933, other oxonol dyes disclosed, for instance, in U.S. Pat. Nos. 2,533,472, and 3,379,533, British Patent 1,278,621, JP-A-1-134447 and JP-A-1-183652, azo dyes disclosed, for instance, in British Patents 575,691, 680,631, 599,623, 786,907, 907,125, and 1,045,609, U.S. Pat. No. 4,255,326 and JP-B-59-211043, azomethine dyes disclosed, for instance, in JP-A-50-100116, JP-A-54-118247, and British Patents 2,014,598 and 750,031, anthraquinone dyes disclosed in U.S. Pat. No. 2,865,752, arylidene dyes disclosed, for instance, in U.S. Pat. Nos. 2,533,009, 2,688,541, and 2,538,008, British Patents 584,609, and 1,210,252, JP-A-50-40625, JP-A-51-3623, JP-A-51-10927, JP-A-54-118247, JP-B-48-3286 and JP-B-59-37303, styryl dyes disclosed, for instance, in JP-B-28-3082, JP-B-44-16594 and JP-B-59-28898, triarylmethane dyes disclosed, for instance, in British Patents 446,583, and 1,335,422 and JP-A-59-228250, merocyanine dyes disclosed, for instance, in British Patents 1,075,653, 1,153,341, 1,284,730, 1,475,228 and 1,542,807 and cyanine dyes disclosed, for instance, in U.S. Pat. Nos. 2,843,486, and 3,294,539 and JP-A-1-291247.

The following methods can be employed to prevent diffusion of these dyes.

For example, methods in which a hydrophilic polymer having reverse charge of a dissociated anionic dye is allowed to coexist in a layer as a mordant, and the dye is localized in the specified layer by its mutual reaction with the dye molecules are disclosed, for instance, in U.S. Pat. Nos. 2,548,564, 4,124,386 and 3,625,694.

Also, methods in which a specified layer is dyed using a water-insoluble solid dye are disclosed, for instance, in JP-A-56-12639, JP-A-55-155350, JP-A-55-155351, JP-A-63-27838, JP-A-63-197943 and European Patent 15,601.

In addition, methods in which a specified layer is dyed using metal salt fine grains to which a dye is adsorbed are disclosed, for instance, in U.S. Pat. Nos. 2,719,088, 2,496,841, and 2,496,843 and JP-A-60-45237.

The photosensitive material of the present invention may contain various surface active agents for use in various purposes such as their use as coating auxiliary, prevention of static electrification, improvement of slipping property, improvement of emulsification and dispersion, prevention of adhesion and improvement of photographic characteristics (for example, development enhancement, contrast heightening and sensitization).

In carrying out the present invention, other additive agents are used together with a silver halide emulsion or other hydrophilic colloid, and examples of such agents include a discoloration preventing agent, an inorganic or organic hardening agent, a color fogging preventing agent, an ultraviolet ray absorbing agent, a mordant, a plasticizer, a latex polymer, a mat and the like. Their illustrative examples are described in "Research Disclosure", vol. 176 (1978, XI), D-17643 and the like.

Also, the photosensitive material of the present invention uses gelatin or the like hydrophilic polymer as a protective colloid.

The finished silver halide emulsion or the like is coated on an appropriate support such as baryta paper, resin coat paper, synthetic paper, triacetate film, polyethylene terephthalate film, other plastic base, glass plate or the like.

The exposure for obtaining photographic images can be carried out in the usual way. That is, any one of various known light sources can be used, which include natural light (sunlight), tungsten lamp, fluorescent lamp, mercury lamp, xenon arc lamp, carbon arc lamp, xenon flashing light, cathode ray tube flying spot and the like. The exposure time may be not only within the range of from $1/1{,}000$ second to 1 second usually used for cameras can be used, but also shorter than $1/1{,}000$ second, for example, within the range of from $1/10^4$ to $1/10^6$ second by the use of xenon flashing light or cathode ray tube, or longer than 1 second. As occasion demands, spectral composition of the light to be used in the exposure may be controlled using color filters. Alternatively, the exposure may be effected by a light emitted from a fluorescent substance exited, for example, by electron beam, X rays, $\gamma$ rays or $\alpha$ rays.

Any of known methods and known processing solutions, such as those which are described in "Research Disclosure", vol. 176, pp. 28–30 (RD-17643), can be applied to the photographic processing of sensitive materials of the present invention. The photographic processing may be either a photographic processing for the formation of silver images (black-and-white photographic processing) or a photographic processing for the formation of dye images (color photographic processing), depending on each purpose. The processing temperature is selected from a range of from 18° C. to 50° C., but it may be lower than 18° C. or higher than 50° C.

A magnetic record-supported silver halide photosensitive material (to be referred to as "sensitive material" hereinafter in some cases) which may be used in the present invention can be prepared by a method in which a preliminarily heat-treated polyester thin layer support described in detail in JP-A-6-35118, JP-A-6-17528 or *JIII Journal of Technical Disclosure,* No. 94-6023 published by Japan Institute of Invention and Innovation, such as a polyethylene aromatic dicarboxylate based polyester support having a thickness of from 50 μm to 300 μm, preferably from 50 μm to 200 μm, more preferably from 80 to 115 μm, most preferably from 85 to 105 μm, is treated with heat (anneal) at a temperature of from 40° C. to its glass transition point for a period of from 1 to 1,500 hours, subjected to its surface treatment, for example, with ultraviolet ray irradiation described in JP-B-43-2603, JP-B-43-2604 or JP-B-45-3828 or with corona discharge described in JP-B-48-5043 or JP-A-51-131576, undercoated in accordance with the method described in U.S. Pat. No. 5,326,689, if necessary arranging the undercoat layer described in U.S. Pat. No. 2,761,791, and then coated with the ferromagnetic grains described in JP-A-59-23505, JP-A-4-195726 or JP-A-6-59357.

In this connection, the aforementioned magnetic layer may have a stripe shape as described in JP-A-4-124642 and JP-A-4-124645.

Thereafter, this was subjected to the anti-static treatment of JP-A-4-62543 as occasion demands and then finally coated with a silver halide emulsion. In this case, the silver halide emulsion described in JP-A-4-166932, JP-A-3-41436 or JP-A-3-41437 is used.

It is desirable that the sensitive material obtained in this manner is produced in accordance with the production management method described in JP-B-4-86817, and the production data are recorded in accordance with the method described in JP-B-6-87146. Thereafter, or before that, this is cut to a film having a width smaller than the conventional 135 size in accordance with the method described in JP-A-4-125560, and perforations are punched in one side of the film, two holes per small format image plane, such that it matches with the format image plane which is smaller than the conventional one.

The thus obtained film is used by putting it into the cartridge packing of JP-A-4-157459, the cartridge described in FIG. 9 in the Examples of JP-A-5-210202, the film patrone described in U.S. Pat. No. 4,221,479 or the cartridge described in U.S. Pat. Nos. 4,834,306, 4,834,366, 5,226,613 or 4,846,418.

With regard to the film cartridge or film patrone to be used herein, a type in which a tongue can be contained is desirable from the viewpoint of light shading ability, like the case described in U.S. Pat. Nos. 4,848,693 or 5,317,355.

Also desirable are a cartridge having a locking mechanism like the case described in U.S. Pat. Nos. 5,296,886, and a cartridge on which the use conditions are displayed and a cartridge having a double exposure preventing function as described in U.S. Pat. No. 5,347,334.

In addition, as described in JP-A-6-85128, a cartridge in which a film can easily be installed by simply inserting the film into the cartridge may be used.

The film cartridges produced in this manner can be used for pertinent photographing, development processing and enjoyment of various photographs, by means of a camera, a developing machine, a laboratory machine as described below.

For example, functions of the film cartridge (patrone) can fully be exerted by the use of a simple loading type camera described in JP-A-6-8886 or JP-A-6-99908, an automatic winding type camera described in JP-A-6-57398 or JP-A-6-101135, a camera described in JP-A-6-205690 in which different films can be exchanged in the course of photographing, a camera described in JP-A-5-293138 or JP-A-5-283382 in which information at the time of photographing, such as panoramic photographing, high definition photographing or normal photographing (possible to carry out magnetic recording capable of selecting print aspect ratio), can be magnetically recorded on films, a camera having a double exposure preventing mechanism as described in JP-A-6-101194 and a camera having a mechanism for displaying working conditions such as of films and the like as described in JP-A-5-150577.

The films photographed in this manner may be processed with the automatic developing machine described in JP-A-6-222514 or JP-A-6-222545, making use of the method for using magnetic recording on films described in JP-A-6-95265 or JP-A-4-123054 or the aspect ratio selecting function described in JP-A-5-19364, before, during or after the processing.

In the case of a cinematography type development, the films are processed by splicing them in accordance with the method described in JP-A-5-119461.

During or after the developing processing, they are subjected to the attach/detach treatment described in JP-A-6-148805.

After the processing, the film information may be converted into the prints via back printing and front printing to color paper in accordance with the method described in JP-A- 2-184835, JP-A-4-186335 or JP-A-6-79968.

Also, the prints may be returned to customers together with index prints described in JP-A-5-11353 or JP-A-5-232594 and the return cartridges.

In addition, a silver halide color photosensitive material is preferably used, which is a color sensitive material in which it has on its support at least one layer for each of a blue-sensitive silver halide emulsion layer containing a yellow color-forming coupler, a green-sensitive silver halide emulsion layer containing a magenta color-forming coupler and a red-sensitive silver halide emulsion layer containing a cyan color-forming coupler and at least one layer of a silver halide emulsion layer that provides an interlayer effect to entire portion of said red-sensitive silver halide emulsion layer, wherein said silver halide emulsion layer that provides an interlayer effect contains a compound represented by a formula (I).

Such a sensitive material is described in detail in JP-A-7-159950 (U.S. Pat. No. 5,538,838).

The present invention will be explained below in more detail by reference of Examples, but the invention should not be construed as being limited thereto.

EXAMPLE 1

(1) Preparation of emulsion

Nuclei of tabular grains were obtained by adding 1.9M $AgNO_3$ aqueous solution and 1.9M KBr aqueous solution by a double jet method at a rate of 25 ml/min for 70 seconds to an aqueous solution containing gelatin having an average molecular weight of 15,000 (consisting of 1,200 ml of water, 7.0 g of gelatin and 4.5 g of KBr), while stirring the gelatin solution at 30° C. The unit "M" as used herein means "mol/l". A 400 ml portion of the thus prepared emulsion was used as seed crystals, 650 ml of an inert gelatin aqueous solution (containing 20 g of gelatin and 1.2 g of KBr) was added thereto and the mixture was subjected to aging at 75°

C. for 40 minutes. To the mixture were added an $AgNO_3$ aqueous solution (containing 1.7 g of $AgNO_3$) spending 1 minute and 30 seconds and then 7.0 ml of $NH_4NO_3$ (50% by weight) aqueous solution and 7.0 ml of $NH_3$ (25% by weight), subsequently carrying out additional aging for 40 minutes.

Next, the emulsion was adjusted to pH 7 with $HNO_3$ (3N), to which were subsequently added 1.0 g of KBr, 366.5 ml of 1.9M $AgNO_3$ aqueous solution and 366.5 ml of 1.9M KBr aqueous solution, 53.6 ml of 1.9M $AgNO_3$ aqueous solution and 53.6 ml of 1.9M KBr (containing 33.3 mol % of KI) aqueous solution and then 160.5 ml of 1.9M $AgNO_3$ aqueous solution and 160.5 ml of 1.9M KBr aqueous solution in that order, while keeping the pAg value at 7.9, thereby obtaining an emulsion 1.

The thus obtained emulsion 1 was comprised of triple structure grains having a region of the highest silver iodide content in the intermediate shell, and their average aspect ratio was 2.8 and the ratio of the tabular grains having an aspect ratio of 3 or more to the total project area was 26%. Coefficient of variation of the grain size was 7%, and the average grain size was 0.98 $\mu$m as diameter of sphere having the same volume as that of a grain (hereinafter referred to as "sphere-equivalent diameter").

The emulsion 1 was subjected to desalting by the usual flocculation method and then gold, sulfur or selenium sensitization was suitably carried out in the presence of a sensitizing dye which was added in a predetermined amount based on 1 mol of silver.

(2) preparation of coated samples

Samples 101 to 112 were prepared by coating the emulsion layer and protective layer shown in Table 1 on a triacetyl cellulose film support on which an undercoat layer has been arranged.

TABLE 1

Emulsion coating conditions (1) Emulsion layer (1) Emulsion . . . Emulsion 1 (see Table 2 for dyes used)
(silver, $2.1 \times 10^{-2}$ mol/m$^2$)
Coupler ($1.5 \times 10^{-3}$ mol/m$^2$)

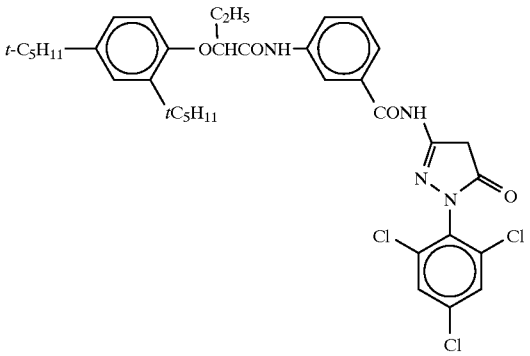

| | |
|---|---|
| Tricresyl phosphate | (1.10 g/m$^2$) |
| Gelatin | (2.30 g/m$^2$) |

(2) Protective layer

| | |
|---|---|
| 2,4-Dichloro-6-hydroxy-s-triazine sodium salt | (0.08 g/m$^2$) |
| Gelatin | (1.80 g/m$^2$) |

These samples were subjected to sensitometry exposure (1/100 second) to carry out the following color development processing.

| Step | Time | Temp. | Quantity of replenisher* | Tank capacity |
|---|---|---|---|---|
| Color development | 2 min 45 sec | 38° C. | 33 ml | 20 liter |
| Bleaching | 6 min 30 sec | 38° C. | 25 ml | 40 liter |
| Water washing | 2 min 10 sec | 24° C. | 1200 ml | 20 liter |
| Fixing | 4 min 20 sec | 38° C. | 25 ml | 30 liter |
| Water washing (1) | 1 min 05 sec | 24° C. | ** | 10 liter |
| Water washing (2) | 1 min 00 sec | 24° C. | 1200 ml | 10 liter |
| Stabilization | 1 min 05 sec | 38° C. | 25 ml | 10 liter |
| Drying | 4 min 20 sec | 55° C. | | |

*Per 1 m of the sample having width of 35 mm
**: Counter-current piping system from (2) to (1)

Next, compositions of the processing solutions are shown below.

| | Mother liquor (g) | Replenisher (g) |
|---|---|---|
| (Color developer) | | |
| Diethylenetriaminepenta-acetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethyl-N-β-hydroxyethylamino]-2-methylaniline sulfate | 4.5 | 5.5 |
| Water to make | 1.0 liter | 1.0 liter |
| pH | 10.05 | 10.05 |
| (Bleaching Solution) | | |
| Sodium ethylenediaminetetra-acetato ferrate trihydrate | 100.0 | 120.0 |
| Disodium ethylenediamine tetraacetate | 10.0 | 11.0 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 liter | 1.0 liter |
| pH | 6.0 | 5.7 |
| (Fixing solution) | | |
| Sodium ethylenediamine-tetraacetate | 0.5 | 0.7 |
| Sodium sulfite | 7.0 | 8.0 |
| Sodium bisulfite | 5.0 | 5.5 |
| Ammonium thiosulfate aqueous solution (70%) | 170.0 ml | 200.0 ml |
| Water to make | 1.0 liter | 1.0 liter |
| pH | 6.7 | 6.6 |
| (Stabilizing solution) | | |
| Formalin (37%) | 2.0 ml | 3.0 ml |
| Polyoxyethylene-p-monononyl Phenyl ether (average polymerization degree: 10) | 0.3 | 0.45 |
| Disodium ethylenediamine-tetraacetate | 0.05 | 0.08 |
| Water to make | 1.0 liter | 1.0 liter |
| pH | 5.8–8.0 | 5.8–8.0 |

Density of each sample after the processing was measured using a green filter to evaluate its fresh sensitivity and fog.

The sensitivity was defined as the reciprocal of exposure amount which gave a density of fog level plus 0.2, and the sensitivity of each sample was expressed as a relative value to the value of the sample 101 which was defined as 100. The emulsion and methine compound used in each sample and results of the measurement of the sensitivity of each sample are shown in Table 2.

TABLE 2

| Sample No. | Methine compound | Amount added (mol/Ag mol) | Sensitivity | Remarks |
|---|---|---|---|---|
| 101 | S-1 | $2.0 \times 10^{-4}$ | 100 (standard) | Comparison |
| 102 | S-2 | " | 85 | " |
| 103 | S-3 | " | 105 | " |
| 104 | (1) | " | 155 | Invention |
| 105 | (2) | " | 145 | " |
| 106 | (3) | " | 144 | " |
| 107 | (4) | " | 156 | " |
| 108 | (5) | " | 149 | " |
| 109 | (7) | " | 146 | " |
| 110 | (9) | " | 145 | " |
| 111 | (35) | " | 150 | " |
| 112 | (18) | " | 160 | " |

S-1

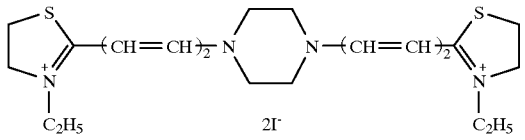

S-2

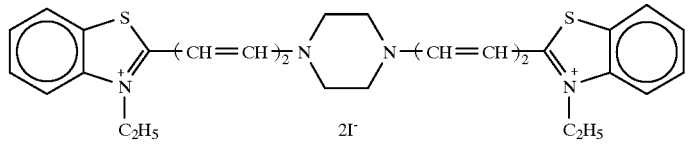

S-3

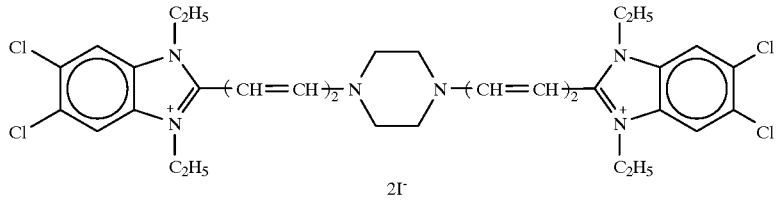

As is evident from the results shown in Table 2, the compounds for use in the present invention have high sensitivity in comparison with the comparative compounds.

EXAMPLE 2

(1) Preparation of emulsion 2

Nuclei of tabular grains were obtained by adding 1.9M AgNO3 aqueous solution and 1.9M KBr aqueous solution by a double jet method at a rate of 25 ml/min for 70 seconds to an aqueous solution containing gelatin having an average molecular weight of 15,000 (consisting of 1,200 ml of water, 7.0 g of gelatin and 4.5 g of KBr), while stirring the gelatin solution at 30° C. A 350 ml portion of the thus prepared emulsion was used as seed crystals, 650 ml of an inert gelatin aqueous solution (containing 20 g of gelatin and 1.2 g of KBr) was added thereto and the mixture was subjected to aging at 75° C. for 40 minutes. To the mixture were added an $AgNO_3$ aqueous solution (containing 1.7 g of $AgNO_3$) spending 1 minute and 30 seconds and then 6.2 ml of $NH_4NO_3$ (50% by weight) aqueous solution and 6.2 ml of $NH_3$ (25% by weight), subsequently carrying out additional aging for 40 minutes.

Next, the emulsion was adjusted to pH 7 with $HNO_3$ (3N), to which were subsequently added 1.0 g of KBr, 366.5 ml of 1.9M $AgNO_3$ aqueous solution and 366.5 ml of 1.9M KBr aqueous solution, 53.6 ml of 1.9M $AgNO_3$ aqueous solution and 53.6 ml of KBr (containing 33.3 mol % of KI) aqueous solution and then 160.5 ml of 1.9M $AgNO_3$ aqueous solution and 160.5 ml of 1.9M KBr aqueous solution in that order, while keeping the pAg value at 8.3, thereby obtaining an emulsion 2.

The thus obtained emulsion 2 was comprised of triple structure grains having a region of the highest silver iodide content in the intermediate shell, and their average aspect ratio was 6.7, the ratio of the tabular grains having an aspect ratio of 6 or more to the total project area was 80% and the ratio of the tabular grains having an aspect ratio of from 3 to 100 to the total project area was about 95%. Coefficient of variation of the grain size was 11%, and the average grain size was 1.00 $\mu$m as sphere-equivalent diameter.

The emulsion 2 was subjected to desalting by the usual flocculation method and then gold, sulfur or selenium sensitization was suitably carried out in the presence of a sensitizing dye.

(2) preparation of coated samples

Using the emulsion 2, samples 201 to 212 were prepared by coating the emulsion layer and protective layer in the same manner as described in Example 1 on a triacetyl cellulose film support on which an undercoat layer has been arranged.

These samples were subjected to sensitometry exposure (1/100 second) in the same manner as described in Example 1 to carry out the color development processing and density measurement in the same manner as described in Example 1. The methine compound used in each sample and results of the measurement of sensitivity are shown in Table 3. The sensitivity of each sample was expressed as a relative value to the value of the sample 201 which was defined as 100.

TABLE 3

| Sample No. | Methine compound | Amount added (mol/Ag mol) | Sensitivity | Remarks |
|---|---|---|---|---|
| 201 | S-1 | $2.0 \times 10^{-4}$ | 100 (standard) | Comparison |
| 202 | S-2 | " | 87 | " |
| 203 | S-3 | " | 106 | " |
| 204 | (1) | " | 185 | Invention |
| 205 | (2) | " | 174 | " |
| 206 | (3) | " | 175 | " |
| 207 | (4) | " | 487 | " |
| 208 | (5) | " | 178 | " |
| 209 | (7) | " | 175 | " |
| 210 | (9) | " | 173 | " |
| 211 | (35) | " | 181 | " |
| 212 | (18) | " | 198 | " |

As is evident from the results shown in Tables 2 and 3, the methine compounds for use in the present invention become higher in sensitivity when the emulsion has an aspect ratio of 3 or more.

EXAMPLE 3

(1) Preparation of emulsion 3

While stirring, to 1.5 liters of a 0.8% low molecular weight gelatin (molecular weight, 10,000) solution containing 0.05 mol of potassium bromide were added 15 ml of 0.5M silver nitrate solution and 15 ml of 0.5M potassium bromide solution for 15 seconds by a double jet method. During this period, the gelatin solution was kept at 40° C. The gelatin solution was found to have a pH value of 5.0 at this stage. After completion of the addition of these compounds, the mixture was heated to 75° C. A 220 ml portion of 10% trimellitic acid-modified gelatin (trimellitic modification ratio, 95%) was added thereto, and the emulsion was then subjected to aging for 20 minutes. Thereafter, to the aged emulsion was added 80 ml of 0.47M silver nitrate solution.

After additional aging for 10 minutes, 150 g of silver nitrate was added thereto spending 60 minutes, while simultaneously adding a potassium bromide solution containing 5 mol % of potassium iodide with an accelerating amount (its final flow rate was 19 times higher than the initial flow rate) so that the pBr value was maintained at 2.55, by a control double jet method at a constant potential of 0 mV. After completion of their addition, 30 ml of 10% KI solution was added to the resulting mixture. After adjusting pH of the emulsion to 7.2 by adding 1N NaOH, 327 ml of 0.5M silver nitrate solution and 327 ml of 0.5M potassium bromide solution to which 16.4 ml of $10^{-2}$M yellow prussiate solution has been added were added to the emulsion spending 20 minutes by the control double jet method at a potential of 0 mV. (Shell formation) Thereafter, the emulsion was cooled to 35° C. and washed with water by the usual flocculation method, and 80 g of deionized alkali-treated ossein gelatin and 40 ml of 2% $Zn(NO_3)_2$ were added to, and dissolved in, the emulsion which was then adjusted to pH 6.5 and pAg 8.6 and stored in a cold and dark chamber. This emulsion was a silver iodobromide emulsion of tabular grains having a coefficient of variation of a diameter of circle having the same area as the projected area of each grain (to be referred to as "circle-equivalent diameter" hereinafter) of 15%, a circle-equivalent diameter of 2.5 $\mu$m and an average thickness of 0.10 $\mu$m and containing 5.7 mol % of silver iodide.

The emulsion was optimally subjected to chemical sensitization at 60° C. with sodium thiosulfate, potassium chloroaurate and potassium thiocyanate.

(2) preparation of coated samples

Using the emulsion 3, samples 301 to 312 were prepared by coating the emulsion layer and protective layer in the same manner as described in Example 1 on a triacetyl cellulose film support on which an undercoat layer has been arranged. These samples were subjected to sensitometry exposure (1/100 second) in the same manner as described in Example 1 to carry out the color development processing and density measurement in the same manner as described in Example 1. The methine compound used in each sample and results of the measurement of sensitivity are shown in Table 4. The sensitivity of each sample was expressed as a relative value to the value of the sample 301 which was defined as 100. As is evident from the results shown in Tables 2, 3 and 4, the methine compounds for use in the present invention become higher in sensitivity when the emulsion has higher aspect ratio.

TABLE 4

| Sample No. | Methine compound | Amount added (mol/Ag mol) | Sensitivity | Remarks |
|---|---|---|---|---|
| 301 | S-1 | $2.0 \times 10^{-4}$ | 100 (standard) | Comparison |
| 302 | S-2 | " | 88 | " |
| 303 | S-3 | " | 107 | " |
| 304 | (1) | " | 201 | Invention |
| 305 | (2) | " | 193 | " |
| 306 | (3) | " | 195 | " |
| 307 | (4) | " | 200 | " |
| 308 | (5) | " | 193 | " |
| 309 | (7) | " | 192 | " |
| 310 | (9) | " | 191 | " |
| 311 | (35) | " | 199 | " |
| 312 | (18) | " | 211 | " |

EXAMPLE 4

An emulsion of tabular silver iodobromide grains was prepared in the same manner as for the emulsion L described in Example 5 of JP-A-8-29904 and used as emulsion 4.

A multiple layer color sensitive material was prepared in the same manner as for the sample 101 described in Example 5 of JP-A-8-29904. Samples 401 and 402 were prepared by replacing emulsion L of the 12th layer of the sample 101 described in Example 5 of JP-A-8-29904 by the emulsion 4 and also replacing the ExS-1, 2 or 3 by the sensitizing dye (S-1) or (1) which was added in an amount of $5.0 \times 10^{-4}$ mol based on 1 mol of the silver halide.

In order to examine sensitivity of the thus prepared samples, measurement of yellow density was carried out by exposing them for 1/100 second to the light of Fuji FW Type Sensitometer (Fuji Photo Film Co., Ltd.) through an optical wedge and a blue filter and then subjecting them to a color developing processing using the same processing steps and processing solutions described in Example 1 of JP-A-8-29904. The sensitivity was expressed by the relative value of fog level plus 0.2.

As the results, the sample 402 of the present invention showed a high sensitivity of 135 based on the sensitivity 100 (standard) of the comparative sample 401.

EXAMPLE 5

Emulsions of tetradecahedral silver iodobromide grains were prepared in the same manner as for the emulsion 1 described in Example 1 of JP-A-7-92601, except that the spectral sensitizing dye was replaced by the sensitizing dye (S-1) or (2) which was added in an amount of $8 \times 10^{-4}$ mol based on 1 mol of the silver halide, and they were used as emulsions 501 and 502. Also, emulsions of cubic silver iodobromide grains were prepared in the same manner as for the emulsion 1 described in Example 1 of JP-A-7-92601, except that the silver potential during the second double jet was changed from +65 mV to +115 mV and the spectral sensitizing dye was replaced by the sensitizing dye (S-1) or (2) which was added in an amount of $8\times10^{-4}$ mol based on 1 mol of the silver halide, and they were used as emulsions 503 and 504.

A multiple layer color sensitive material was prepared in the same manner as for the sample 401 described in Example 4 of JP-A-7-92601. Samples 511 and 512 were prepared by replacing the emulsion J of the 15th layer of the sample 401 described in Example 4 of JP-A-7-92601 by the emulsion 501 or 502. In the same manner, samples 513 and 514 were prepared by replacing the emulsion J of the 15th layer of the same Example by the emulsion 503 or 504.

Evaluation of the sensitivity of the thus prepared samples was carried out. The yellow density of these samples was measured by carrying out exposure for 1/50 second and color reversal development processing in the same manner as described in Example 4 of JP-A-7-92601. The sensitivity was obtained by calculating the reciprocal of exposure amount necessary to give a density of 0.2 plus minimum density obtained by giving sufficient exposure, and the result was expressed as its relative value to the sensitivity of the comparative sample 511 which was defined as 100. As the results, the sample 512 of the present invention showed a high sensitivity of 135. Also, the sample 514 of the present invention showed a high sensitivity of 141 when the sensitivity of the comparative sample 513 was used as 100.

EXAMPLE 6

An internal latent image type direct positive emulsion of octahedral silver bromide grains and an internal latent image type direct positive emulsion of hexagonal tabular silver bromide grains were prepared in the same manner as for the emulsion 1 described in Example 1 of JP-A-5-313297 and used as emulsion 601.

A color diffusion transfer photographic film was prepared in the same manner as for the sample 101 described in Example 1 of JP-A-5-313297. Samples 611 and 612 were prepared by replacing the emulsion 2 and sensitizing dye (3) of the 16th layer of the sample 101 described in Example 1 of JP-A-5-313297 by the emulsion 601 and the sensitizing dye (S-1) or (3). The sensitizing dye (S-1) or (3) was added in an amount of $9\times10^{-4}$ mol based on 1 mol of the silver halide.

In order to examine sensitivity of the thus prepared samples, the transfer density was measured by a color densitometer by employing the same exposure, processing steps and processing solutions described in Example 1 of JP-A-5-313297. The sensitivity was expressed by the relative value of density 1.0. The sample 612 of the present invention showed a high sensitivity of 125 when the sensitivity of the comparative sample 611 was defined as 100.

EXAMPLE 7

To be used as emulsion samples 701 and 702, emulsions of silver chlorobromide grains were prepared in the same manner as for the emulsion F described in Example 2 of JP-A-4-142536, except that the red sensitive sensitizing dye (S-1) was not added prior to the sulfur sensitization, that a gold sulfur sensitization was optimally carried out by the joint use of chloroauric acid in addition to the sulfur sensitization of triethylthiourea and that the sensitizing dye (S-2) or (35) was added in an amount of $2\times10^{-4}$ mol based on 1 mol of the silver halide after the gold sulfur sensitization.

Multiple layer color printing paper was prepared in the same manner as for the sample 20 described in Example 1 of JP-A-6-347944. Samples 711 and 712 were prepared by replacing the emulsion of the 1st layer of the sample 20 described in Example 1 of JP-A-6-347944 by the emulsion 701 or 702.

In order to examine sensitivity of the thus prepared samples, color developing processing was carried out by exposing them for 1/10 second to the light of Fuji FW Type Sensitometer (Fuji Photo Film Co., Ltd.) through an optical wedge and a blue filter and using the same processing steps and processing solutions as described in Example 1 of JP-A-6-347944. As the results, the sample 712 of the present invention showed a high sensitivity of 131 based on the sensitivity of the comparative sample 711 when it was defined as 100.

EXAMPLE 8

An emulsion of tabular silver chloride grains was prepared in the same manner as for the emulsion A described in Example 1 of JP-A-8-122954, the chemical sensitization (B) of the Example was carried out, except that the sensitizing dye-1 or 2 was replaced by the sensitizing dye (S-1) or (4) which was added in an amount of $2\times10^{-4}$ mol based on 1 mol of the silver halide, thereby obtaining emulsions 801 and 802. Coated samples 811 and 812 were prepared by replacing the emulsion described in Example 1 of JP-A-8-122954 with the emulsions 801 or 802 and coating the emulsion layer and a surface protecting layer in combination on both sides of a support by a simultaneous extrusion method in the same manner as described in the Example. The amount of coated silver per one side was controlled at 1.75 g/m$^2$.

In order to examine sensitivity of the thus prepared samples, each of the samples was exposed for 0.05 second from both sides using X ray Ortho Screen HGM manufactured by Fuji Photo Film Co., Ltd. and then processed using an automatic developing machine and processing solutions in the same manner as described in Example 1 of JP-A-8-122954. The sensitivity was obtained by calculating logarithm of the reciprocal of exposure amount necessary to give a density of fog plus 0.1, and the result was expressed as its relative value to the sensitivity of the sample 811 which was defined as 100. As the results, the sample 812 of the present invention showed a high sensitivity of 134.

Similar effect was obtained when the exposure was carried out using HR-4 or HGH instead of the X ray Ortho Screen HGM.

EXAMPLE 9

An emulsion of tabular silver chloride grains was prepared in the same manner as for the emulsion D described in Example 2 of JP-A-8-227117, except that the sensitizing dyes 2 and 3 were not used, and used as emulsion 901.

Coated samples were prepared in the same manner as for the coated sample F described in Example 3 of JP-A-8-227117. Coated samples 911 and 912 were prepared by replacing the emulsion F and sensitizing dye-1 of the coated sample F described in Example 3 of JP-A-8-227117 with the emulsions 901 and the sensitizing dye (S-1) or (5). In this case, the replaced sensitizing dye (S-1) or (5) was added in an amount of $5\times10^{-4}$ mol based on 1 mol of the silver halide.

In order to examine sensitivity of the thus prepared samples, photographic characteristics were compared by exposing them for 1/100 second to the light of Fuji FW Type Sensitometer (Fuji Photo Film Co., Ltd.) through an optical wedge and a blue filter and then subjecting them to a Fuji Photo Film CN16 processing.

The sensitivity was expressed as logarithm of the reciprocal of exposure amount necessary to give a density of fog plus 0.2, and the sensitivity of the sample 911 was defined as 100. The sample 912 of the present invention showed a high sensitivity of 129.

EXAMPLE 10

An emulsion of octahedral silver chloride grains was prepared in the same manner as for the emulsion F described in Example 3 of JP-A-8-227117 and used as emulsion layer 1001.

Coated samples were prepared in the same manner as for the coated sample F described in Example 3 of JP-A-8-227117. Coated samples 1011 and 1012 were prepared by replacing the emulsion F and sensitizing dye-1 of the coated sample F described in Example 3 of JP-A-8-227117 with the emulsions 1001 and the sensitizing dye (S-3) or (18). In this case, the replaced sensitizing dye (S-3) or (18) was added in an amount of $5\times10^{-4}$ mol based on 1 mol of the silver halide.

In order to examine sensitivity of the thus prepared samples, photographic characteristics were compared by exposing them for 1/100 second to the light of Fuji FW Type Sensitometer (Fuji Photo Film Co., Ltd.) through an optical wedge and a blue filter and then subjecting them to a Fuji Photo Film CN16 processing. The sensitivity was expressed as logarithm of the reciprocal of exposure amount necessary to give a density of fog plus 0.2, and the sensitivity of the sample 1011 was defined as 100. The sample 1012 of the present invention showed a high sensitivity of 131.

EXAMPLE 11

An emulsion of silver iodobromide grains was prepared in the same manner as for the emulsion E described in Example 1 of JP-A-7-159950 and used as emulsion 11.

A multiple layer color sensitive material was prepared in the same manner as for the sample 101 described in Example 1 of JP-A-7-159950. Samples 1101 and 1102 were prepared by replacing the emulsion E of the 10th layer of the sample 101 described in Example 1 of JP-A-7-159950 by the emulsion 11 and also replacing the ExS-3 by the sensitizing dye (S-1) or (7) which was added in an amount of $9.8\times10^{-4}$ mol based on 1 mol of the silver halide.

In order to examine sensitivity of the thus prepared samples, measurement of magenta density was carried out by exposing them for 1/100 second to the light of Fuji FW Type Sensitometer (Fuji Photo Film Co., Ltd.) through an optical wedge and a blue filter and then subjecting them to a color developing processing using the same processing steps and processing solutions described in Example 1 of JP-A-7-159950.

The sensitivity was expressed by the relative value of fog plus 0.2. As the results, the sample 1102 of the present invention showed a high sensitivity of 132 based on the sensitivity 100 (standard) of the comparative sample 1101.

In addition, when color reproducability (ability to discriminate green) was evaluated by sensory analysis in the same manner as described in Example 1 of JP-A-7-159950, the sample 1102 of the present invention showed a value of 7.8 which was superior to the value 32 of the sample 1101.

Thus, as has been described in the foregoing, it is evident that a silver halide photosensitive material having high sensitivity can be obtained by the present invention.

While the invention has been described in detail and with reference to specific examples thereof, it will be apparent to one skilled in the art that various changes and modifications can be made therein without departing from the spirit and scope thereof.

What is claimed is:

1. A silver halide photosensitive material comprising a support having provided thereon a silver halide emulsion layer, said silver halide photosensitive material comprising at least one of the compounds represented by the following formula

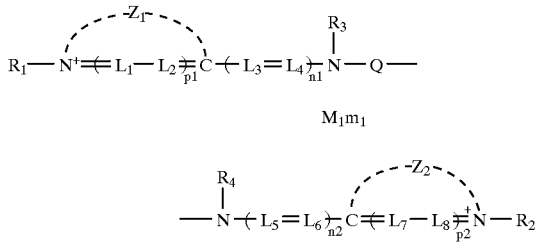

wherein $Z_1$ and $Z_2$ each represents an atomic group necessary for forming a five- or six-membered nitrogen-containing heterocyclic ring, $R_1$, $R_2$, $R_3$ and $R_4$ each represents an alkyl group, an aryl group or a heterocyclic group, Q represents a divalent linking group or a single bond, with the proviso that at least one of $R_1$, $R_2$, $R_3$, $R_4$ and Q is substituted with a water-soluble group, $L_1$, $L_2$, $L_3$, $L_4$, $L_5$, $L_6$, $L_7$ and $L_8$ each represents a methine group, $n_1$ and $n_2$ each is 0, 1, 2, 3 or 4, $P_1$ and $P_2$ each is 0 or 1, $M_1$ represents a charge equilibrium counter ion, and $m_1$ is a number of from 0 to 10, which is necessary for neutralizing charge of the molecule.

2. The silver halide photosensitive material according to claim 1, wherein at least one of $R_1$, $R_2$, $R_3$, $R_4$ and Q is substituted with a sulfo group or a salt thereof.

* * * * *